US007484713B1

(12) United States Patent
Young

(10) Patent No.: US 7,484,713 B1
(45) Date of Patent: Feb. 3, 2009

(54) DUAL DRIVE WINCH SYSTEM

(75) Inventor: Larry P. Young, Grand Forks, ND (US)

(73) Assignee: Telpro, Inc., Grand Forks, ND (US)

( * ) Notice: Subject to any disclaimer, the term of this patent is extended or adjusted under 35 U.S.C. 154(b) by 0 days.

(21) Appl. No.: 12/027,060

(22) Filed: Feb. 6, 2008

(51) Int. Cl.
*B66D 1/14* (2006.01)

(52) U.S. Cl. ..... 254/342; 254/334; 254/339; 254/357

(58) Field of Classification Search ..... 254/334, 254/339, 342, 357
See application file for complete search history.

(56) References Cited

U.S. PATENT DOCUMENTS 4,456,227 A * 6/1984 Notenboom ..... 254/350
5,374,035 A * 12/1994 Santos ..... 254/339
5,862,885 A * 1/1999 Carmitchel ..... 187/231
5,871,069 A * 2/1999 Carmitchel ..... 187/231
6,561,489 B1 * 5/2003 Wakefield ..... 254/323
7,028,989 B2 * 4/2006 Flynn et al. ..... 254/323
2007/0069190 A1 * 3/2007 Metcalf et al. ..... 254/8 B

OTHER PUBLICATIONS

Telpro, Inc., GILLIFT Model 70 (Brochure), additional information also available on website, <retrieved from http://www.telproinc.com/ProductDetail.asp?PID=12 Feb. 6, 2008>.
E-Z Spread N' Lift Industries, <retrieved from http://www.e-zspreadnlift.com/ Feb. 6, 2008>.
SPECIALTYTOOL.com, Kab Jak, <retrieved from http://www.specialtytools.com/contact_us.php?3dCsid=564b6ccf717ffcb58cdd871b74d5f58f Feb. 6, 2008>.

* cited by examiner

*Primary Examiner*—Emmanuel M Marcelo

(57) ABSTRACT

A dual drive winch system for efficiently providing a winch operable either manually or via an external motor. The dual drive winch system generally includes a rotatable spool adapted to have an elongated member wound thereon, a first drive unit mechanically connected to the spool and a second drive unit mechanically connected to the spool. The first drive unit rotates the spool via a manual force applied to the first drive unit and the second drive unit rotates the spool via a powered force applied to the second drive unit.

20 Claims, 9 Drawing Sheets

DUAL DRIVE WINCH SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to winches and more specifically it relates to a dual drive winch system for efficiently providing a winch operable either manually or via an external motor.

2. Description of the Related Art

Any discussion of the related art throughout the specification should in no way be considered as an admission that such related art is widely known or forms part of common general knowledge in the field.

Winches have been in use for years and are utilized for a variety of applications (e.g. drywall lifts, cabinet lifts, etc.). Typically, a winch is comprised of a mechanical device that is utilized to wind or unwind an elongated cable, strap or rope. The winch generally includes a spool and an attached crank to rotate the spool. Prior winches may also include a gear assembly to allow an operator to incrementally rotate the spool and also allow the operator to brake the spool to prevent the spool from rotating in an undesired direction.

The prior winches, such as winches utilized for drywall lifts or cabinet lifts also do not offer a winch that utilizes an external motor to wind and unwind the cable, strap or rope upon the spool along with the optional method of manual rotation. The utilization of both a motor and a manual source may be efficient in many applications for winches, such as when elevating a cabinet structure a majority of a desired height and then utilizing the manual source to fine tune the height of the cabinet structure. Because of the inherent problems with the related art, there is a need for a new and improved dual drive winch system for efficiently providing a winch operable either manually or via an external motor.

BRIEF SUMMARY OF THE INVENTION

The general purpose of the present invention is to provide a dual drive winch system that has many of the advantages of the winches mentioned heretofore. The invention generally relates to a which includes a rotatable spool adapted to have an elongated member wound thereon, a first drive unit mechanically connected to the spool and a second drive unit mechanically connected to the spool. The first drive unit rotates the spool via a manual force applied to the first drive unit and the second drive unit rotates the spool via a powered force applied to the second drive unit.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a dual drive winch system for efficiently providing a winch operable either manually or via an external motor.

Another object is to provide a dual drive winch system that utilizes an external drill to operate the winch.

An additional object is to provide a dual drive winch system that may be utilized to elevate and lower cabinetry.

A further object is to provide a dual drive winch system that includes a braking system.

Another object is to provide a dual drive winch system that may be easily retrofitted to a preexisting winch.

Another object is to provide a dual drive winch system that allows an operator to more rapidly unwind or wind the cable, rope or strap from the winch.

Another object is to provide a dual drive winch system that allows an operator to quickly switch between manually operating the winch and operating the winch with an external motor.

Another object is to provide a dual drive winch system that reduces a back and forth swaying motion of a lift structure by centralizing the source that rotates the winch spool (i.e. external motor device applied directly to the axis, wherein the crank extends laterally outward from the axis).

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1A:
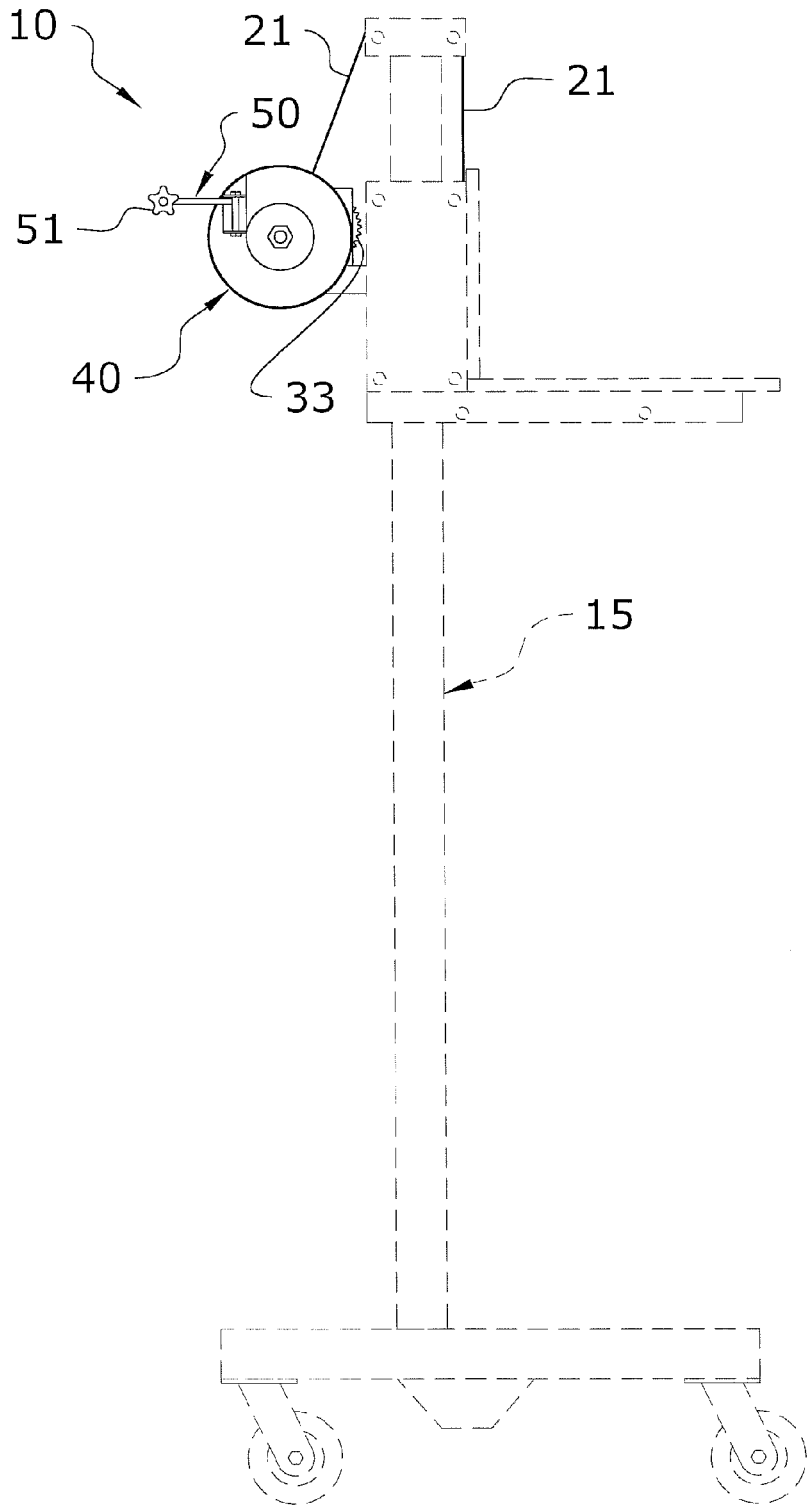
FIG. 1*a* is a side view of the present invention utilized with a cabinet lift.
Figure 1B:
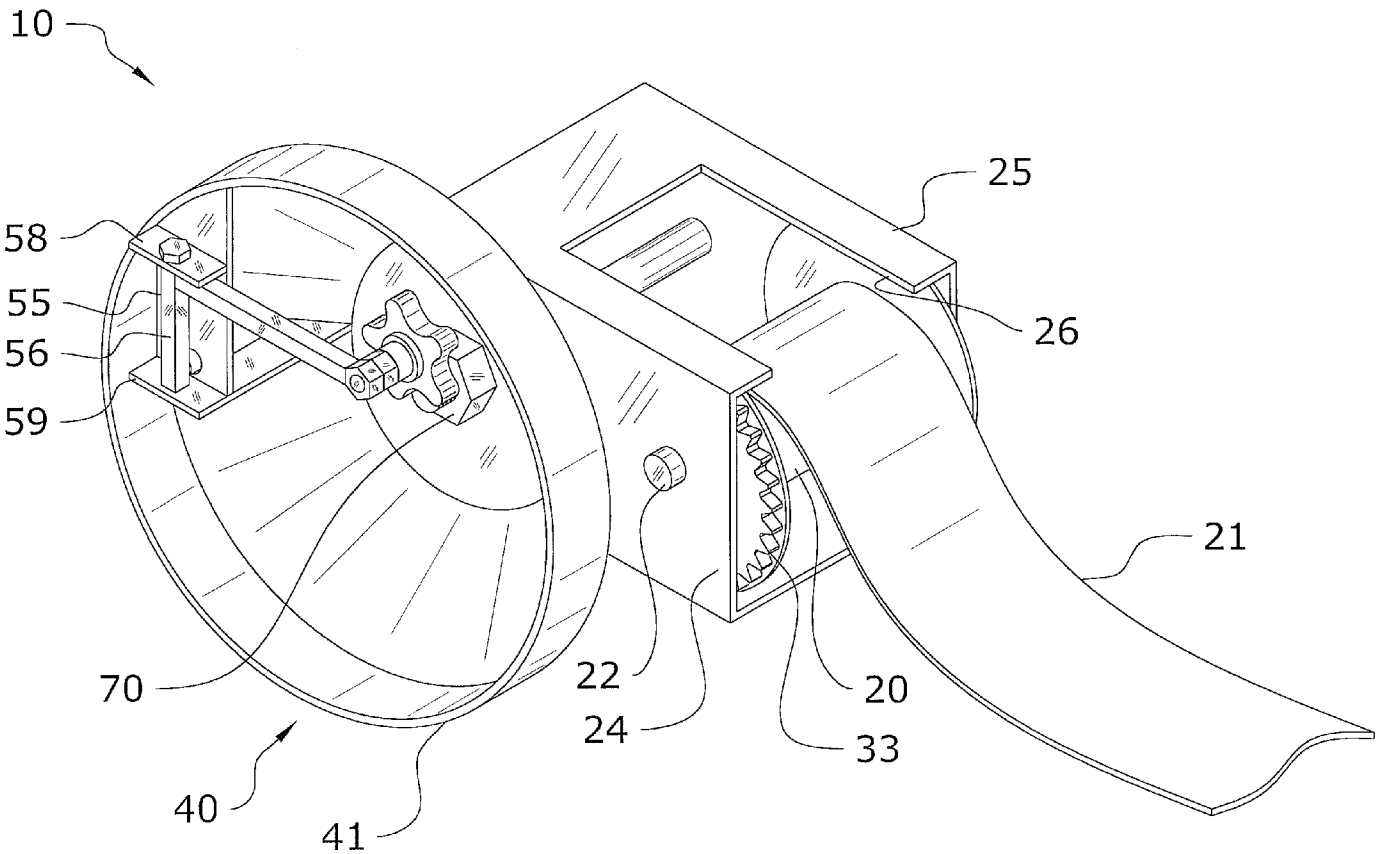
FIG. 1*b* is an upper perspective view of the present invention.
Figure 2:
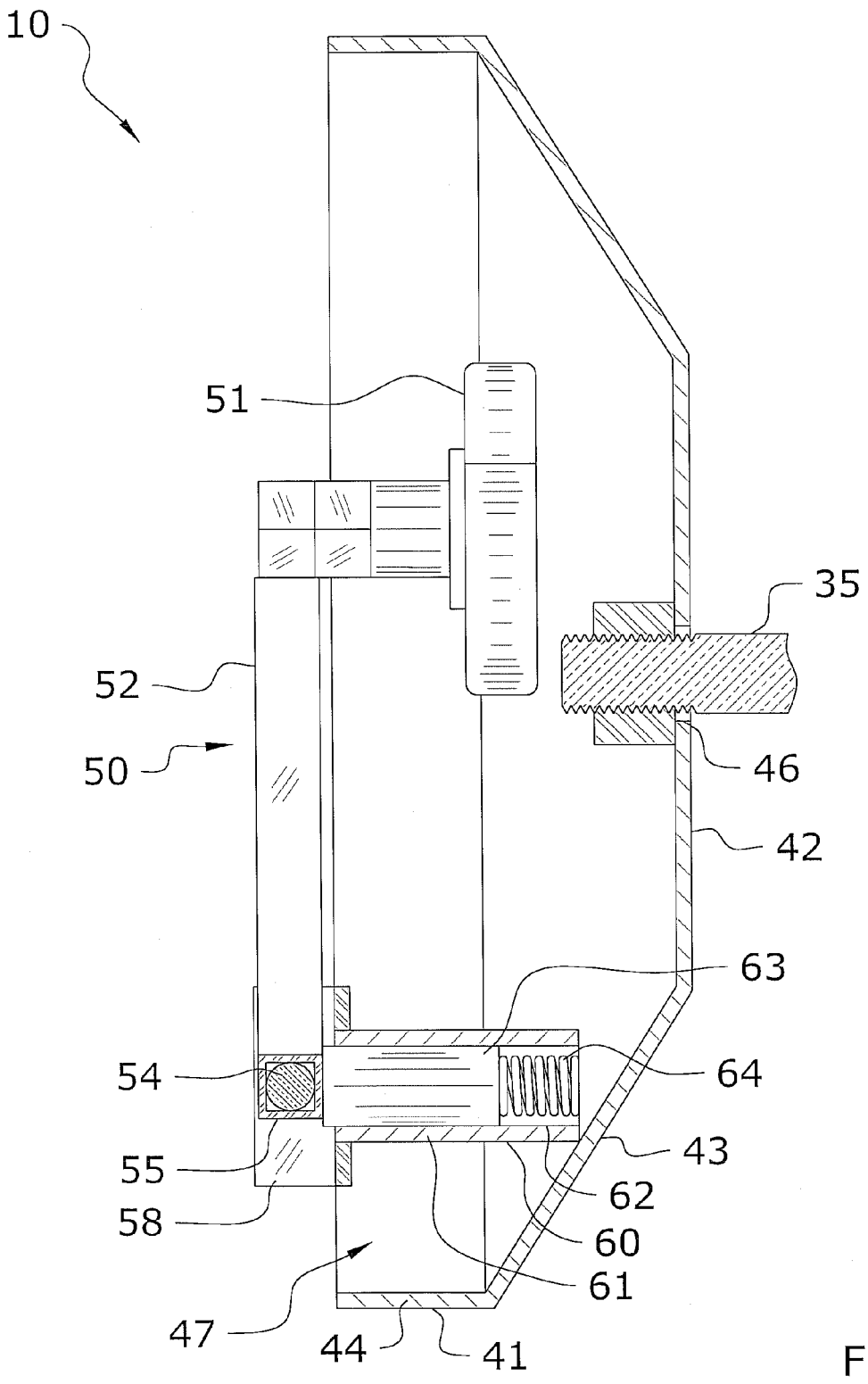
FIG. 2 is a cross-sectional view of the present invention illustrating the crank mechanism secured in a nonuse position.
Figure 3:
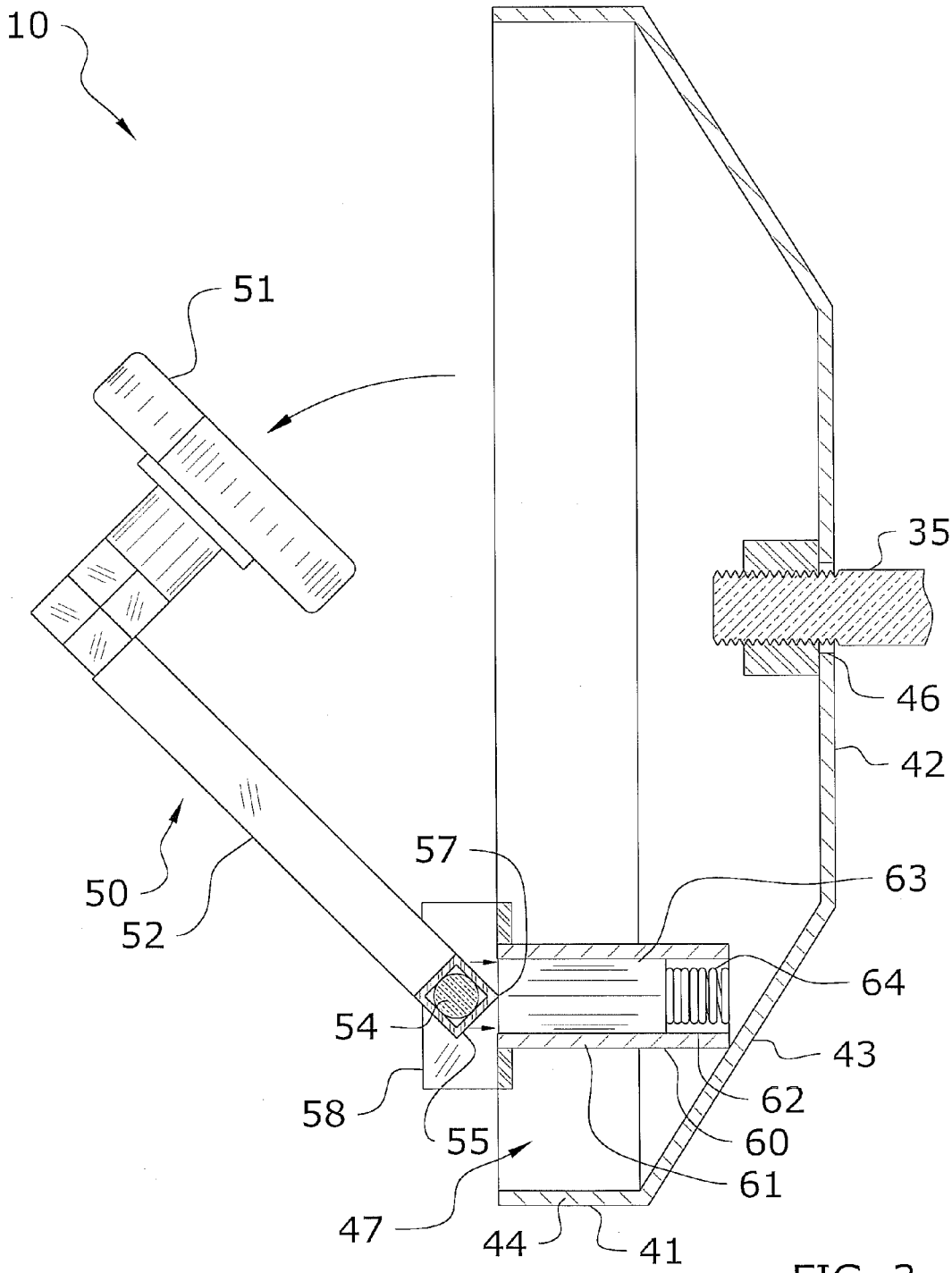
FIG. 3 is a cross-sectional view of the present invention illustrating the crank mechanism being pivoted towards an in-use position, wherein the corner of the adjustment member is pushing the plunger inwardly.
Figure 4:
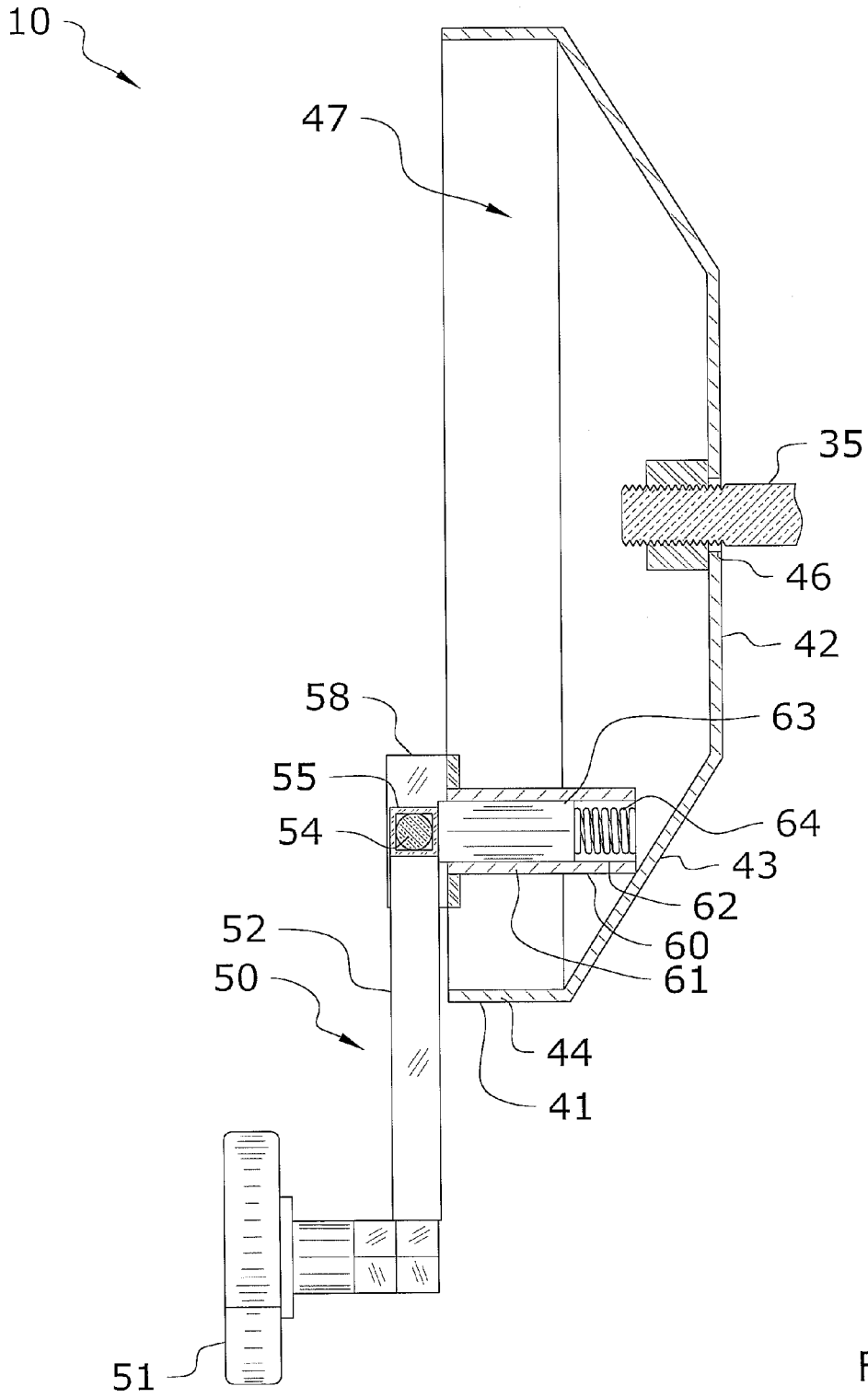
FIG. 4 is a cross-sectional view of the present invention illustrating the crank mechanism secured in an in-use position.
Figure 5:
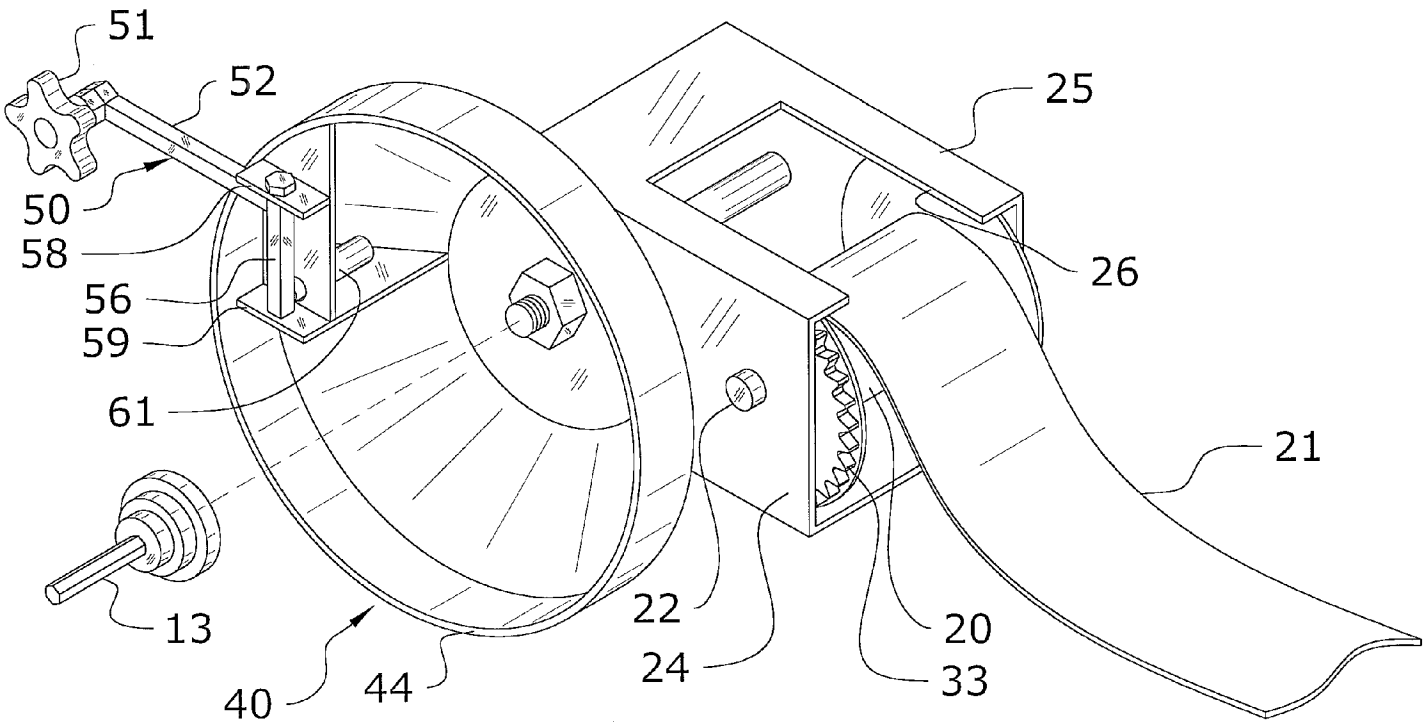
FIG. 5 is an upper perspective view of the present invention with the adapter aligned and exploded from the second drive unit.
Figure 6:
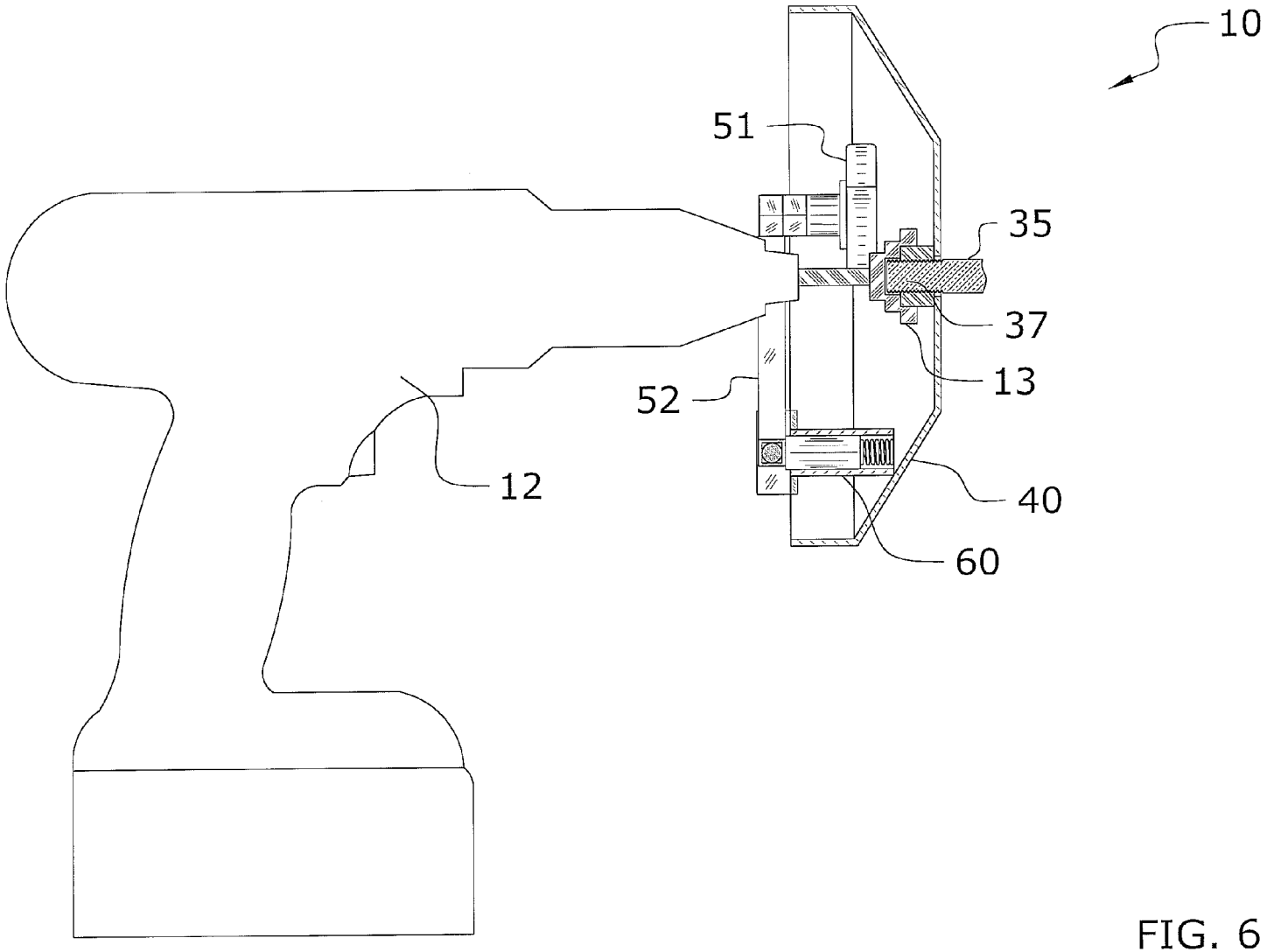
FIG. 6 is a cross-sectional view of the present invention illustrating the crank mechanism secured in a nonuse position and the second drive unit being utilized.
Figure 7:
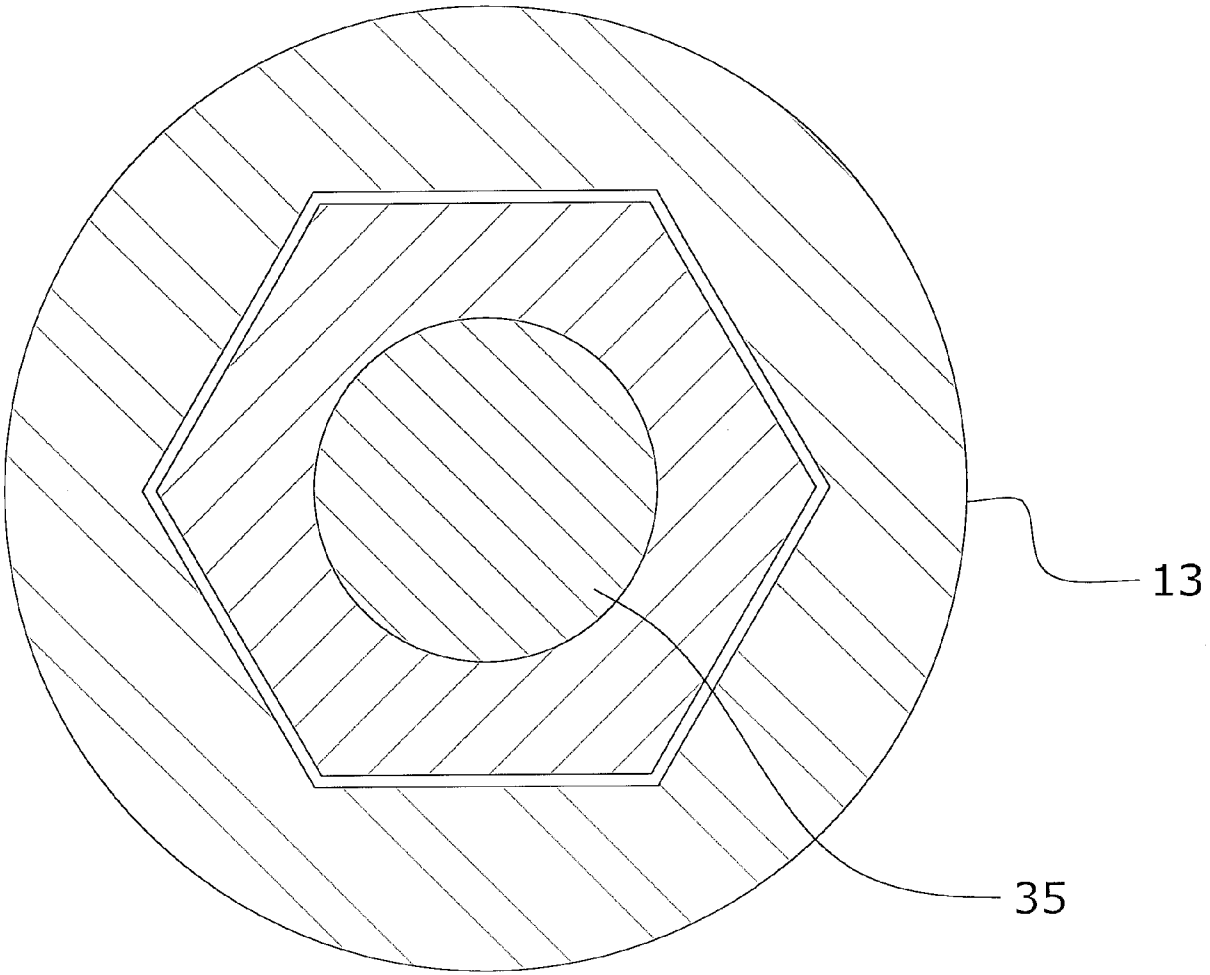
FIG. 7 is a cross-sectional view showing the connection of the adapter to the second drive unit.
Figure 8:
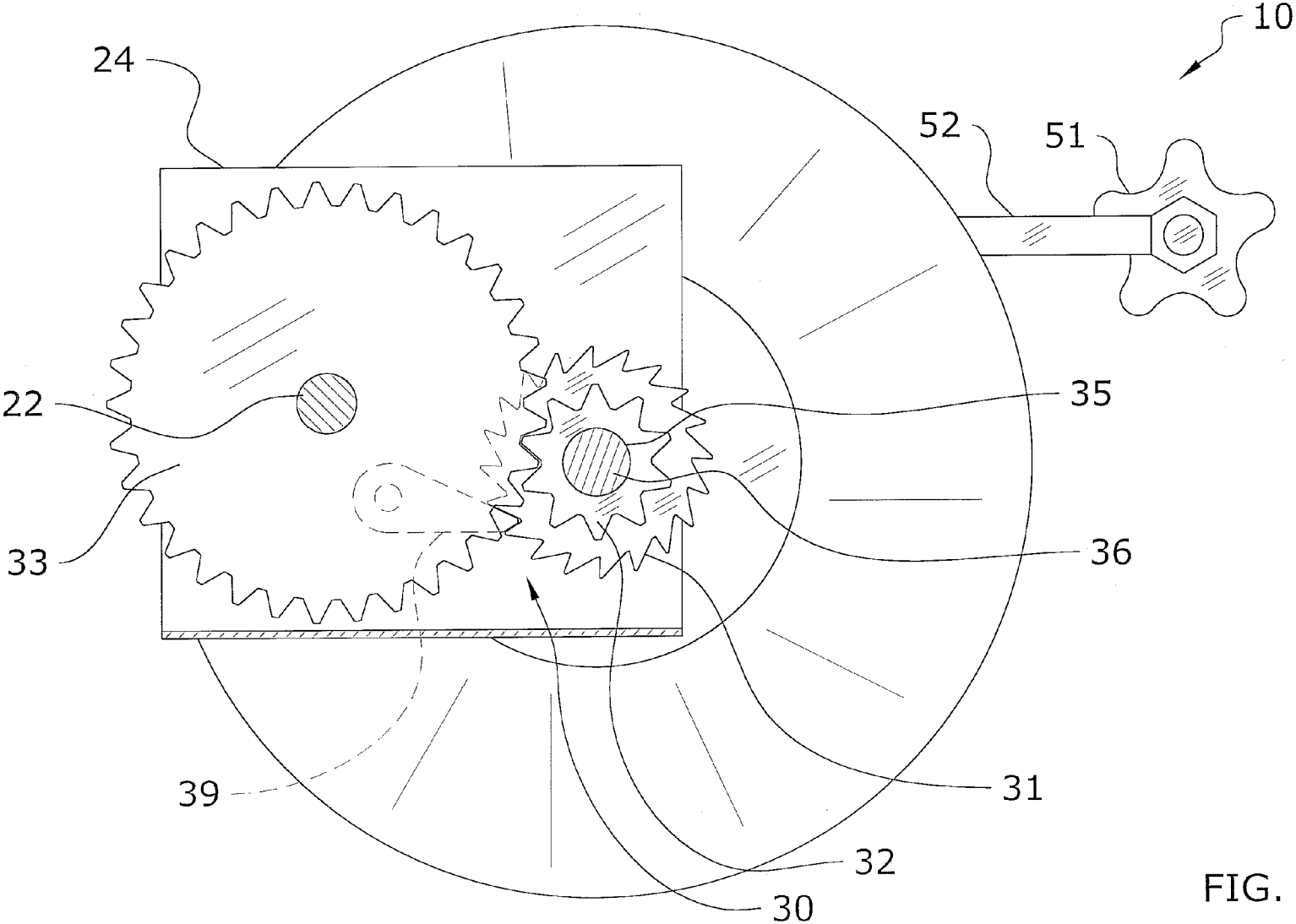
FIG. 8 is a sectional view taken through a portion of the enclosure illustrating the interconnection of the gear assembly and the braking assembly.

Turning now descriptively to the drawings, in which similar reference characters denote similar elements throughout the several views, FIGS. 1*a* through 8 illustrate a dual drive winch system 10, which comprises a rotatable spool 20 adapted to have an elongated member 21 wound thereon, a first drive unit 40 mechanically connected to the spool 20 and a second drive unit 70 mechanically connected to the spool 20. The first drive unit 40 rotates the spool 20 via a manual force applied to the first drive unit 40 and the second drive unit 70 rotates the spool 20 via a powered force applied to the second drive unit 70.

The present invention is preferably designed for and utilized with a cabinet lift 15 as illustrated in FIG. 1*a*. The rotatable spool 20 is rotatably supported by the cabinet lift 15, wherein the present invention is utilized to raise and lower cabinets positioned upon a platform of the cabinet lift 15 via the elongated member 21 plifting upon and lowering a platform. It is appreciated however that the present invention may be utilized in various other applications including but not limited to drywall lifts and various other systems requiring a winch.

B. Spool

The spool 20 and gear assembly 30 of the present invention are preferably comprised of a standard spool 20 and gear assembly 30 of a hand cranked winch. The present invention may be utilized in various types of applications, such as but not limited to elevating and lowering cabinetry. An elongated member 21 is selectively wound around the spool 20, wherein the elongated member 21 winds and winds with respect to the spool 20 during applied rotation of the first drive unit 40 or the second drive unit 70. The elongated member 21 may be various types of configurations common with winches, such as but not limited to a strap, a rope or a cable. The spool 20 also rotates upon a shaft 22 supported and rotatably attached with respect to an enclosure 24.

The enclosure 24 partially surrounds the spool 20 and gear assembly 30. The enclosure 24 includes a guard portion 25 extending over the teeth of the gears 31, 32, 33 to prevent an operator from getting a piece of material caught in the gears 31, 32, 33 or engaging the gears 31, 32, 33 themselves. The enclosure 24 also includes an opening 26 adjacent the spool 20 to allow the elongated member 21 to move in and out of the enclosure 24 when winding and unwinding upon the spool 20.

The gear assembly 30 preferably includes a first gear 31, a second gear 32 and a third gear 33 to both transfer a rotational force to the spool 20 and to provide a braking force upon the spool 20 and thus stop the elongated member 21 from unwinding further than desired from the spool 20. It is appreciated however that the present invention may include more or less gears than in the preferred embodiment.

The first gear 31 is preferably attached to a drive shaft 35 extending through the enclosure 24. The first gear 31 rotates with the drive shaft 35 and along with a braking member 39 define a braking assembly of the present invention. The first gear 31 and braking member 39 preferably function in a ratchet and pawl manner. Thus the first gear 31 and the braking member 39 prevent the drive shaft 35 and thus spool 20 from rotating in an undesired direction. The braking assembly may also include various other components (e.g. spring, etc.) common with ratchet and pawl devices.

The second gear 32 is attached to the drive shaft 35 near an outer end 37 of the drive shaft 35. The second gear 32 rotates along with the drive shaft 35. The second gear 32 interconnects with the third gear 33 to rotate the spool 20. The second gear 32 is attached to the shaft 22 of the spool 20 and rotates along with the shaft 22 and the spool 20. Thus, rotating the drive shaft 35 causes the second gear 32 to rotate, wherein the second gear 32 rotates the third gear 33 and thus the spool 20.

An inner end 36 of the drive shaft 35 extends outwardly from the enclosure 24 to connect to the first drive unit 40 and the second drive unit 70. When retrofitting a prior art winch to utilize the first drive unit 40 and the second drive unit 70, the manual crank of the prior art winch is simply removed from the drive shaft 35 and the first drive unit 40 and the second drive unit 70 are subsequently attached to the drive shaft 35.

C. First Drive Unit

The first drive unit 40 is utilized to mechanically rotate the spool 20, wherein the first drive unit 40 is comprised of a manually operated device. The first drive unit 40 is attached adjacent the inner end 36 of the drive shaft 35 and also rotates the drive shaft 35, wherein the drive shaft 35 and first drive unit 40 rotate together. The first drive unit 40 also radiates outwardly from the drive shaft 35, wherein a perimeter of the first drive unit 40 is larger than a perimeter of the drive shaft 35 to allow an operator to more easily manually rotate the drive shaft 35 via the first drive unit 40 because of the increased leverage provided by the first drive unit 40.

The first drive unit 40 preferably includes a disc 41. The disc 41 includes an inner portion 42 with a central opening 46 extending through the inner portion 42 to receive the inner end 36 of the drive shaft 35. A tapered portion 43 radiates outwardly from the inner portion 42 and an outer lip 44 extends from the tapered portion 43. A cavity 47 also preferably extends within the disc 41 and is defined by the tapered portion 43 and the outer lip 44. A first diameter of said first drive unit 40 is substantially larger than a second diameter of said spool 20. Further a first rotational diameter of the disc 41 and a second rotational diameter of the crank mechanism 50 is substantially greater than a third rotational diameter of the spool 20.

The outer lip 44 may be perpendicular with the inner portion 42. The outer lip 44 may also curve inwardly so that an operator may more easily grasp the outer lip 44. The outer lip 44 may further be covered in a gripping material (e.g. rubber, etc.) to allow an operator to better grasp the outer lip 44. It is appreciated that rotating the disc 41 causes the drive shaft 35 to rotate, wherein the disc 41 is attached to the drive shaft 35.

The first drive unit 40 may alternately or in conjunction be rotated via a crank mechanism 50. The crank mechanism 50 is preferably attached to the disc 41 and is further preferably attached within a cavity 47 of the disc 41. The crank mechanism 50 includes a handle 51 and an arm 52. The handle 51 is rotatably attached to the arm 52 and may be comprised of various configurations to allow the operator to better grasp the handle 51.

The arm 52 radiates from the disc 41 to increase the leverage for the operator to rotate the drive shaft 35 while utilizing the crank mechanism 50. The arm 52 is further preferably comprised of an L-shaped configuration to allow the handle 51 to extend inwardly within the cavity 47 when the crank mechanism 50 is not in-use and to allow the handle 51 to extend outwardly from the disc 41 when the crank mechanism 50 is in-use.

The arm 52 is preferably pivotally attached with respect to the disc 41. An adjustment member 55 preferably perpendicularly extends from the arm 52 opposite the handle 51. The adjustment member 55 rotates around a support member 54 (e.g. bolt, etc.), wherein the support member 54 is attached between a first support 58 and a second support 59 and wherein the first support 58 and the second support 59 extend from the disc 41.

The adjustment member 55 is preferably comprised of a square hollow tubing or other type of hollow sleeve configuration including a plurality of planar surfaces (e.g. hexagonal, octagonal, etc.) and able to rotate around with respect to the plunger 63 of the spring plunger device 60. The planar surfaces of the adjustment member 55 rest flat against the plunger 63 to prevent the crank mechanism 50 from pivoting about the disc 41 when not desired.

A spring plunger device 60 extends between the adjustment member 55 of the crank mechanism 50 and the inner wall of the disc 41 to selectively retain the crank mechanism 50 in a desired position. The spring plunger device 60 includes a retaining sleeve 61, a bore 62 extending through the retaining sleeve 61, a spring 64 positioned within the bore 62 adjacent the inner wall of the disc 41 and a plunger 63 extending from the spring 64 and positioned between the spring 64 and the adjustment member 55. When pivoting the arm 52 of the crank mechanism 50 about the disc 41, the corners 57 (between adjacent planar surfaces 56) of the adjustment member 55 push the plunger 63 inward.

Once the corners 57 have moved past the plunger 63, the plunger 63 is able to extend outwards (via pressure from the spring 64) and engage the next respective planar surface 56 of the adjustment member 55. The planar surface 56 and the end of the plunger 63 are thus parallel and rest against each other. The arm 52 is thus prevented from pivoting unless a certain amount of pivotal force is exerted upon the arm 52 to overcome the force of the spring 64 pushing the plunger 63 against the adjustment member 55.

D. Second Drive Unit

The second drive unit 70 is preferably driven by a powered source (i.e. external motor 12). The external motor 12 provides a rotational force to rotate the second drive unit 70. The external motor 12 may be comprised of various configurations, such as but not limited to a powered drill. An adapter 13 is also preferably rotated by the powered source, wherein the adapter 13 is preferably comprised of a type of socket (e.g. hex bit socket, etc.) or other device to precisely fit over the second drive unit 70.

The second drive unit 70 is preferably comprised of a bolt configuration to threadably attach upon the inner end 36 of the drive shaft 35. The second drive unit 70 is positioned within the cavity 47 of the disc 41 of the first drive unit 40. The second drive unit 70 also preferably retains the first drive unit 40 upon the drive shaft 35.

Rotation of the second drive unit 70 subsequently rotates the drive shaft 35 which in turn rotates the gear assembly 30 to rotate the spool 20. It is further appreciated that rotating the second drive unit 70 rotates the first drive unit 40 and likewise, rotating the first drive unit 40 rotates the second drive unit 70.

E. Operation of Preferred Embodiment

In use, a cabinet is positioned upon the cabinet lift 15 preferably with the cabinet lift is in a lowered position. An external motor 12 (e.g. powered drill, etc.) is mechanically connected to the second drive unit 70 and the second drive unit 70 is rotated in a forward direction via the power of the external motor 12. The rotation of the second drive unit 70 subsequently rotates the spool 20 to wind the elongated member 21 onto the spool 20 and thus raise the cabinet upon the cabinet lift 15.

Utilizing the external motor 12 and the second drive unit 70 prevents the operator from manually working excessively to rotate the spool 20. When the elongated member 21 is wound onto the spool 20 close to a desired distance, the external motor 12 is preferably stopped thus stopping the rotation of the second drive unit 70 and the spool 20. The operator now operates the first drive unit 40 to finely tune the distance that the elongated member 21 is extended from the spool 20 and thus height of the cabinet.

It is appreciated that when utilizing the second drive unit 70, the crank mechanism 50 of the first drive unit 40 is preferably pivoted towards a nonuse position so that the handle 51 extends within the cavity 47 for safety and to prevent the crank mechanism 50 from engaging nearby objects when the disc 41 is spinning via rotation of the second drive unit 70. Likewise, when utilizing the crank mechanism 50 of the first drive unit 40, the crank mechanism 50 is preferably pivoted towards an in-use position outwardly from the disc 41.

It is also appreciated that the first drive unit 40 and the second drive unit 70 may also operate in a reverse manner in a similar manner as previously described, wherein the second drive unit 70 is utilized for unwinding the elongated member 21 from the spool 20 a substantial amount of the distance and the first drive unit 40 is utilized for winding the elongated member 21 upon the spool 20 when it is desired to wind slowly or precisely. It is also appreciated that the brake assembly may be configured in various manners, such as but not limited to preventing the elongated member 21 from unwinding without adjusting the brake assembly or preventing the elongated member 21 from winding without adjusting the brake assembly.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A dual drive winch system, comprising:

a rotatable spool adapted to have an elongated member wound thereon;

a first drive unit mechanically connected to said spool;

wherein said first drive unit rotates said spool via a manual force applied to said first drive unit; and a second drive unit mechanically connected to said spool;

wherein said second drive unit rotates said spool via a powered force applied to said second drive unit;

wherein said second drive unit is comprised of a hex bolt.

2. The dual drive winch system of claim 1, wherein said first drive unit is mechanically connected to said second drive unit.

3. The dual drive winch system of claim 1, wherein said first drive unit and said second drive unit rotate together.

4. The dual drive winch system of claim 1, wherein a first diameter of said first drive unit is substantially larger than a second diameter of said spool.

5. The dual drive winch system of claim 1, wherein said first drive unit includes a circular disc, wherein a rotation of said circular disc rotates said spool.

6. The dual drive winch system of claim 1, wherein said first drive unit includes a crank mechanism to rotate said spool.

7. The dual drive winch system of claim 6, wherein said crank mechanism is pivotally attached to said first drive unit.

8. The dual drive winch system of claim 7, including a spring plunger device to secure said crank mechanism in a pivoted position.

9. The dual drive winch system of claim 1, including a gear assembly mechanically connecting said first drive unit and said second drive unit to said spool.

10. The dual drive winch system of claim 9, wherein said gear assembly includes a braking assembly.

11. The dual drive winch system of claim 1, wherein said powered force is supplied by an external motor.

12. The dual drive winch system of claim 11, wherein said external motor is comprised of a rotating external motor.

13. The dual drive winch system of claim 12, wherein said rotating external motor is comprised of a powered drill.

14. The dual drive winch system of claim 1, including a cabinet lift, wherein said cabinet lift supports said rotatable spool.

15. The dual drive winch system of claim 1, wherein said first drive unit and said second drive unit rotate together.

16. The dual drive winch system of claim 1, wherein a first diameter of said first drive unit is substantially larger than a second diameter of said spool.

17. The dual drive winch system of claim 1, wherein said first drive unit includes a circular disc, wherein a rotation of said circular disc rotates said spool.

18. A dual drive winch system, comprising:

a cabinet lift;

a rotatable spool adapted to have an elongated member wound thereon, wherein said cabinet lift supports said rotatable spool;

a first drive unit mechanically connected to said spool;

wherein said first drive unit rotates said spool via a manual force applied to said first drive unit; and a second drive unit mechanically connected to said spool;

wherein said second drive unit rotates said spool via a powered force applied to said second drive unit;

wherein said first drive unit is mechanically connected to said second drive unit;

wherein said first drive unit and said second drive unit rotate together;

wherein a first diameter of said first drive unit is substantially larger than a second diameter of a shaft of said spool;

wherein said first drive unit includes a circular disc, wherein a rotation of said circular disc rotates said spool;

wherein said first drive unit includes a crank mechanism to rotate said spool;

wherein said crank mechanism is pivotally attached with respect to said circular disc of said first drive unit;

a spring plunger device to secure said crank mechanism in a pivoted position; and a gear assembly mechanically connecting said first drive unit and said second drive unit to said spool;

wherein said gear assembly includes a braking assembly;

wherein said powered force is supplied by an external motor, wherein said external motor is comprised of a rotating external motor and wherein said rotating external motor is comprised of a powered drill.

19. A dual drive winch system, comprising:

a rotatable spool adapted to have an elongated member wound thereon;

a first drive unit mechanically connected to said spool;

wherein said first drive unit rotates said spool via a manual force applied to said first drive unit;

a second drive unit mechanically connected to said spool;

wherein said second drive unit rotates said spool via a powered force applied to said second drive unit;

wherein said first drive unit includes a crank mechanism to rotate said spool;

wherein said crank mechanism is pivotally attached to said first drive unit; and a spring plunger device to secure said crank mechanism in a pivoted position.

20. The dual drive winch system of claim 19, wherein said first drive unit is mechanically connected to said second drive unit.

* * * * *